US007870624B1

(12) United States Patent
Winston

(10) Patent No.: US 7,870,624 B1
(45) Date of Patent: Jan. 18, 2011

(54) HEIGHT-ADJUSTABLE EXAMINING TABLE

(76) Inventor: Mary H. Winston, 4775 Shoshonee Trail, College Park, GA (US) 30349

( * ) Notice: Subject to any disclaimer, the term of this patent is extended or adjusted under 35 U.S.C. 154(b) by 0 days.

(21) Appl. No.: 12/315,473

(22) Filed: Dec. 3, 2008

Related U.S. Application Data

(60) Provisional application No. 61/004,983, filed on Dec. 3, 2007.

(51) Int. Cl.
*A47B 7/00* (2006.01)

(52) U.S. Cl. ..... 5/611; 5/612; 5/613; 5/614; 5/610

(58) Field of Classification Search ..... 5/611, 5/617, 618, 608, 607, 610, 612, 613
See application file for complete search history.

(56) References Cited

U.S. PATENT DOCUMENTS

| | | | | |
|---|---|---|---|---|
| 3,334,951 | A | 8/1967 | Douglass, Jr. et al. | |
| 3,833,211 | A * | 9/1974 | Mueller et al. | 5/624 |
| 4,057,240 | A | 11/1977 | Damico et al. | |
| 4,284,268 | A * | 8/1981 | Gauthier | 5/624 |
| 4,552,403 | A | 11/1985 | Yindra | |
| 4,657,235 | A * | 4/1987 | Schar | 5/611 |
| 5,507,050 | A * | 4/1996 | Welner | 5/611 |
| 5,522,098 | A * | 6/1996 | Podgorschek | 5/611 |
| 6,079,065 | A * | 6/2000 | Luff et al. | 5/613 |
| 6,209,463 | B1 | 4/2001 | Koharchik et al. | |
| 6,435,110 | B1 | 8/2002 | Keil | |
| 6,499,156 | B1 * | 12/2002 | Dirst | 5/611 |
| 6,648,416 | B2 * | 11/2003 | O'Connor et al. | 5/636 |
| 6,772,460 | B2 * | 8/2004 | Heimbrock et al. | 5/611 |
| 7,073,464 | B2 | 7/2006 | Keil | |
| 7,167,739 | B2 | 1/2007 | Van De Rijdt et al. | |
| 7,512,998 | B2 * | 4/2009 | Martin et al. | 5/617 |
| 2003/0115674 | A1 * | 6/2003 | Heimbrock et al. | 5/617 |
| 2004/0068797 | A1 * | 4/2004 | Smith et al. | 5/617 |

* cited by examiner

*Primary Examiner*—Robert G Santos
*Assistant Examiner*—Brittany M Wilson
(74) *Attorney, Agent, or Firm*—Montgomery Patent and Design; Robert C. Montgomery

(57) ABSTRACT

An examination table for use in the medical field comprising integral adjustment mechanisms for raising, lowering, and tilting a head cushion portion, is herein disclosed. The adjustment mechanisms further comprise an internal hydraulic moving means. The height adjustment mechanism would allow the tabletop to vary in height from approximately eighteen (18) to thirty-six (36) inches. In this manner, the table would allow a patient to simply sit down and then be elevated to a suitable height for a doctor or other medical personnel to perform needed medical procedures. Such a feature is envisioned as being invaluable to those who are handicapped, elderly, or small in stature.

15 Claims, 7 Drawing Sheets

HEIGHT-ADJUSTABLE EXAMINING TABLE

RELATED APPLICATIONS

The present invention was first described in U.S. Provisional Patent Application No. 61/004,983 filed on Dec. 3, 2007, the entire disclosures of which are incorporated herein by reference.

FIELD OF THE INVENTION

The present invention relates generally to a height-adjustable examining table further comprising a lifting mechanism and a tilting mechanism to raise and lower a head cushion section and a leg cushion section of the table and, more specifically, to utilizing a hydraulically-powered and -operated foot pedal switch device to variably adjust the table to a desired height and a desired head rest angle, thereby allowing a patient to easily enter and exit the table as well as provide a suitable elevation to perform various medical procedures.

BACKGROUND OF THE INVENTION

People with physical disabilities, such as the elderly, the handicapped, or those recovering from injuries or surgery it is difficult to access an examination table in a doctor's office ranks high on the list. Since the sitting area is often the same height as a countertop, a step stool or intermediate platform is often needed for access; even for those of good health and average stature. Such a stool quickly turns into an impossible barrier for many including the elderly, the disabled, little people, or even young children. Accordingly, there is a need for a means by which the elderly, physically disabled, and the like can access an examination table regardless of their physical ability. The development of the invention herein described fulfills this need.

There have been attempts in the past to invent improved medical examination tables. U.S. Pat. No. 7,167,739 issued to Hubertus et al. discloses a medical examination device comprising an examination space, a combination of a frame and a patient table and rack that displaces a patient on the patient table into and out of the examination space. Unfortunately, this patent does not appear to disclose a sectionalized examination table that is configured for individuals with limited mobility or who are wheel chair confined.

U.S. Pat. Nos. 7,073,464 and 6,435,110 issued to Keil discloses veterinary height adjustable wet tables that can be lowered to assist in locating animals to the wet table surface and can be raised to an elevation desirable for veterinary treatment of an animal. Unfortunately, these patents do not appear to disclose a sectionalized medical examination table for humans.

U.S. Pat. No. 6,209,463 issued to Koharchik et al. discloses a medical examination table having an apparatus for support and securing the backrest to an inclined position and self-adjusting drawers. Unfortunately, this patent does not appear to disclose a medical examination table that comprises sectionalized, components that are height-adjustable for ease of use by physically limited and/or wheelchair dependent patients.

U.S. Pat. No. 4,552,403 issued to Yindar discloses a power-operated medical examination table that comprises a pedestal base with an extendable and retractable column. Unfortunately, this patent does not appear to disclose a height-adjustable examination table that possesses the ability to be lowered to a position where physically limited individuals are able to access the table.

U.S. Pat. No. 4,057,240 issued to D'Amico et al. discloses a patient examination table that appears to comprise a table that utilizes an electric motor, cables and pulleys to adjust the height of the table. Unfortunately, this patent does not appear to disclose a height-adjustable medical examination table that utilizes an electrically-powered hydraulic lift system to raise and lower the table, nor does the disclosed patent appear to teach a table that is adaptable for ease of use by physically impaired individuals.

U.S. Pat. No. 3,334,951 issued to Douglass et al. discloses a hydraulically powered lifting examination table. Unfortunately, this patent does not appear to disclose a hydraulic lifting system similar to the system discloses in the instant apparatus, nor does it appear to be configured for ease of use by those with physical limitations including wheel chair bound individuals.

SUMMARY OF THE INVENTION

In light of the disadvantages, as previously discussed, in the prior art; it is apparent that there is a need for a height-adjustable medical examination table.

An object of the height-adjustable examining table comprises a lifting mechanism that allows the apparatus to vary in height from approximately eighteen (18) to thirty-six (36) inches so that a patient may easily enter and exit the apparatus as well as provide elevation to a suitable height to perform various medical procedures.

Another object of the height-adjustable examining table comprises hydraulically-powered height and tilting mechanisms that are operated using a foot pedal switch device.

A further object of the height-adjustable examining table comprises approximate dimensions of fifty-five (55) inches long and twenty-six (26) inches wide.

Still another object of the height adjustable examining table provides a minimum lifting capacity of approximately three-hundred fifty (350) pounds.

Still a further object of the height-adjustable examining table comprises head and leg cushion sections further comprising rectangular padded textile assemblies envisioned to comprise urethane foam or similar filling material that provide a comfortable lying and sitting surface.

Yet another object of the height-adjustable examining table comprises head and leg cushion sections comprising an easily cleaned cushion covering made of vinyl, cloth, leather, or the like.

Yet still another object of the height-adjustable examining table provides additional features such as, but not limited to: drawers, a footstep, a contoured head cushion section, a paper dispenser, and the like.

Yet a further object of the height-adjustable examining table comprises lifting sections that provide a vertically telescoping assembly of interlocking and vertically expanding structures designed to laterally stabilize the lifting frame assembly and apparatus during a loaded state.

Still another object of the height-adjustable examining table comprises a leg cushion section that provides a stationary attachment means to an expandable and height variable lifting frame assembly providing a variety of selectable heights.

Still a further object of the height-adjustable examining table comprises a lifting frame assembly that provides a lifting means to said head and foot cushion sections by elevating said cushion sections from approximately eighteen (18) inches to thirty-six (36) inches above a floor surface, thereby allowing a patient to be elevated from an easily accessible sitting height upward to a normal examination height.

An aspect of the height-adjustable examining table comprises head and leg cushion sections further comprising a cushion covering, a quantity of internal cushion padding, a head cushion frame, and a leg cushion frame. The head cushion section provides a powered pivoting function via an internal tilt cylinder and a torsion arm.

A further aspect of the height-adjustable examining table comprises a leg cushion section that further comprises a pair of conventional stirrups. The stirrups provide typical horizontal and vertical adjustment via a pair of vertical stirrup rod guides, a pair of horizontal stirrup rod guides and corresponding threaded rod locking knobs.

Still another aspect of the height-adjustable examining table comprises a lifting frame assembly that further comprises a first lifting section, a second lifting section, and a third lifting section that provide a vertically telescoping assembly.

Still a further aspect of the height-adjustable examining table comprises adjacent lifting sections attached to each another via a plurality of linear ball-bearing units that further secure the lifting sections in a horizontal attitude while enabling adjacent pairs of lifting sections to move freely within one another vertically during operation of the lift cylinder.

Yet another aspect of the height-adjustable examining table comprises a lifting frame assembly that comprises a protective enclosure to a lifting cylinder, and a tilt cylinder. The lifting cylinder comprises a lifting cylinder shaft which extends in an upward direction affixed at a top end portion to a top horizontal surface of the first cushion frame.

Yet a further aspect of the height-adjustable examining table comprises a tilt cylinder that is affixed to the first lifting section in a horizontal orientation. The tilt cylinder provides angular manipulation of the head cushion section by directly applying a torque force.

Yet still another aspect of the height-adjustable examining table comprises the head and leg cushions attached to one another by a torsion hinge comprising a heavy-duty piano-type hinging device allowing the head cushion section to adjustably pivot at angles ranging from a horizontal to a vertical orientation. The tilt cylinder shaft portion is affixed to the torsion arm via a standard double clevis link.

Another aspect of the height-adjustable examining table comprises a lift cylinder and tilt cylinder that are hydraulically-powered via a common open-loop hydraulic circuit comprising an electric hydraulic motor/pump, a lifting cylinder valve, a tilt cylinder valve, a reservoir, a plurality of hydraulic hoses, and a foot-controlled pedal switch assembly.

Yet another aspect of the height-adjustable examining table comprises a hydraulic motor/pump comprising a common positive-displacement gear pump unit. The lifting and tilt cylinder valves comprise standard double-solenoid three-position hydraulic valves. The reservoir provides a volume of hydraulic fluid thereto the hydraulic motor/pump via a hydraulic hose. Hydraulic fluid is conveyed to said valves and cylinders via a plurality of common high-pressure hydraulic hoses.

Yet a further aspect of the height-adjustable examining table comprises a lifting frame assembly that comprises an attachment means to a base assembly. The base assembly comprises a sturdy assembly of rectangular metal plates providing a laterally expanded foundation to the apparatus and extends outwardly from the lifting frame assembly upon a floor surface. The base assembly comprises four (4) foot pads located along a bottom surface of said base assembly adjacent to each corner position.

Yet another aspect of the height-adjustable examining table comprises a pedal switch assembly further comprises a rugged and protective plastic or metal pedal switch housing, a tilt up pedal switch, a tilt down pedal switch, a lift up pedal switch, and a lift down pedal switch. Operation and control of the hydraulic system is by the pedal switch assembly. Electrical power is conducted from the pedal switch assembly to the valves and hydraulic motor/pump unit via interconnecting control wiring.

A method of installing and utilizing the apparatus may be achieved by performing the following steps: placing or securing the apparatus upon a floor surface within a doctor's office, a hospital, or similar medical establishment; providing electrical power to the apparatus by plugging the power cord into an available 110-volt duplex outlet; lowering a head cushion section of the apparatus by pressing and holding the lift down pedal switch, thereby actuating the lifting cylinder in a downward direction; releasing the lift down pedal switch when the apparatus is at a desired loading height; loading a patient onto the apparatus; raising the apparatus by pressing and holding the lift up pedal switch on the pedal switch assembly; releasing the lift up pedal switch when the leg cushion section portion of the apparatus is at a desired examining height; tilting the head cushion section up or down by pressing and holding the corresponding tilt up pedal switch portion or tilt down pedal switch portion until obtaining a desired reclining angle of the head cushion section; manually adjusting the foot stirrups using the stirrup adjustment rods and the stirrup rod locking knobs as required to prepare the apparatus for a doctor or other medical personnel to perform needed medical procedures; adjusting the position of the head cushion section when finished performing said medical procedures, to facilitate a sitting position by actuating the tilt cylinder using the tilt up pedal switch; lowering the apparatus by actuating the lifting cylinder using the lift down pedal switch; releasing said lifting pedal switch when the apparatus is at a desired unloading height; unloading a patient from the apparatus; and, benefiting from increased safety and reduced effort of persons undergoing medical examinations using the present invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
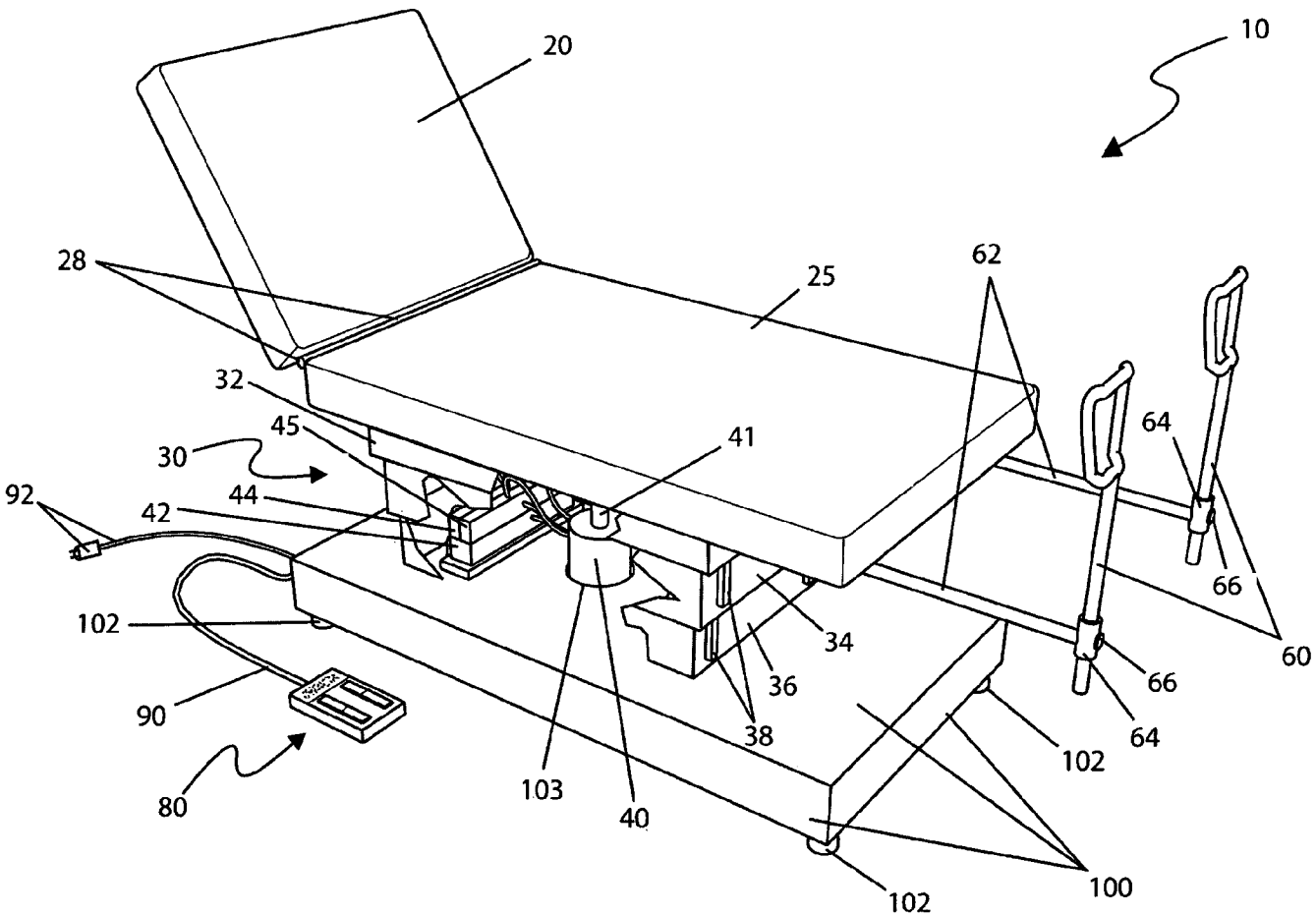
FIG. 1 is a front perspective view of a height-adjustable examining table 10 depicting a partial cut-away portion, according to a preferred embodiment of the present invention.

| | |
|---|---|
| 10 | height-adjustable examining table |
| 20 | head cushion section |
| 21 | cushion covering |
| 22 | cushion padding |
| 23 | head section slot |
| 25 | leg cushion section |
| 26 | head cushion frame |
| 27 | leg cushion frame |
| 28 | torsion hinge |
| 30 | lifting frame assembly |
| 32 | first lifting section |
| 33 | first lifting section slot |
| 34 | second lifting section |
| 35 | second lifting section slot |
| 36 | third lifting section |
| 38 | bearing unit |
| 40 | lifting cylinder |
| 41 | lifting cylinder shaft |
| 42 | hydraulic motor/pump |
| 44 | lifting cylinder valve |
| 45 | tilt cylinder valve |
| 46 | reservoir |
| 47 | hydraulic hose |
| 50 | tilt cylinder |
| 51 | tilt cylinder shaft |
| 52 | double clevis link |
| 54 | torsion arm |
| 60 | stirrup |
| 62 | stirrup adjustment rod |
| 64 | vertical stirrup rod guide |
| 65 | horizontal stirrup rod guide |
| 66 | rod locking knob |
| 80 | pedal switch assembly |
| 81 | pedal switch housing |
| 82 | tilt up pedal switch |
| 84 | tilt down pedal switch |
| 86 | lift up pedal switch |
| 88 | lift down pedal switch |
| 90 | control cord |
| 92 | power cord |
| 100 | base assembly |
| 102 | foot pads |
| 103 | base assembly aperture |
| 105 | fastener |

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a height-adjustable examining table (herein described as the "apparatus") 10, which comprises a lifting mechanism 40 and a tilting mechanism 50 to raise and lower a head cushion section 20 and a leg cushion section 25 of a medical examination table. The height and tilting mechanisms 40, 50 are hydraulically powered and operated using a foot pedal switch device 80. The lifting mechanism 40 would allow the apparatus 10 to vary in height from approximately eighteen (18) to thirty-six (36) inches allowing a patient to easily enter and exit the apparatus 10 as well as provide elevation thereto a suitable height to perform various medical procedures.

Referring now to FIG. 1, a front perspective view of the apparatus 10 depicting a partial cut-away portion, according to the preferred embodiment of the present invention, is disclosed. The apparatus 10 is illustrated here so as to highlight a lifting means thereto the cushion sections 20, 25 via an internal lifting cylinder 40 mounted therewithin a lifting frame assembly 30. The apparatus 10 comprises a head cushion section 20, a leg cushion section 25, a lifting cylinder 40, a hydraulic motor/pump 42, a pair of stirrups 60, and a pedal switch assembly 80. The apparatus 10 comprises standard capabilities similar thereto standard conventional examining tables having approximate dimensions of fifty-five (55) inches long and twenty-six (26) inches wide. The apparatus 10 further provides a minimum lifting capacity of approximately three-hundred fifty (350) pounds. The head and leg cushion sections 20, 25 comprise rectangular padded textile assemblies envisioned to comprise urethane foam or similar filling material, thereby providing a comfortable lying and sitting surface. Said head 20 and leg 25 cushion sections also provide an attachment means thereto one another via a torsion hinge 28 comprising a heavy-duty piano-type hinging device which extends therealong an entire adjacent edge thereby allowing the head cushion section 20 to adjustably pivot at angles ranging from a horizontal to a vertical orientation. The head cushion section 20 provides a powered pivoting function via an internal tilt cylinder 50 and a torsion arm 54 (see FIGS. 3 and 4). The leg section 25 comprises a pair of adjustable stirrups 60 in a similar manner as conventional examining tables common in the industry (see FIG. 4). The leg cushion section 25 further provides a stationary attachment means thereto an expandable and height variable lifting frame assembly 30 along a lower surface thereof, thereby providing a variety of selectable heights. Said lifting frame assembly 30 enables an occupant to easily load thereonto and unload therefrom the apparatus 10 as well as be examined at a desired height above a floor surface. The lifting frame assembly 30 further provides an enclosure thereto the lifting cylinder 40 and the tilt cylinder 50, thereby providing convenient height and angular manipulation thereof the head 20 and leg 25 cushion sections. The lifting 40 and tilt 50 cylinders are hydraulically powered via a motorized hydraulic system comprising an electric hydraulic motor/pump 42 and a foot-controlled pedal switch assembly 80 (see FIGS. 4 and 6). It is also envisioned that the apparatus 10 may provide additional features commonly available on conventional examining tables such as, but not limited to: drawers, a footstep, a contoured head cushion section, a paper dispenser, and the like.

Figure 2B:
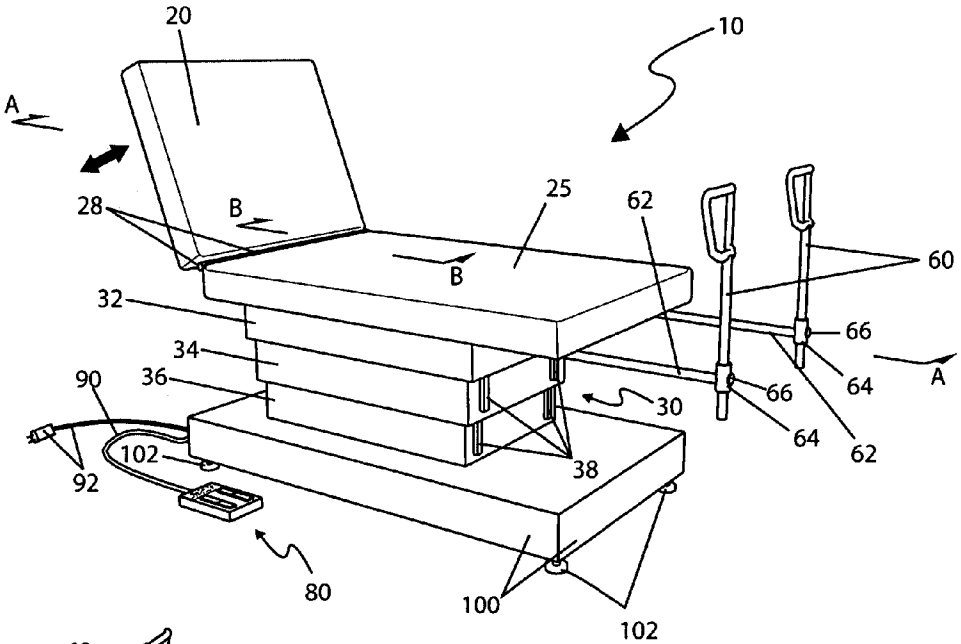
FIG. 2*b* is a perspective view of a height-adjustable examining table 10 depicting a raised state, according to a preferred embodiment of the present invention.
Figure 2A:
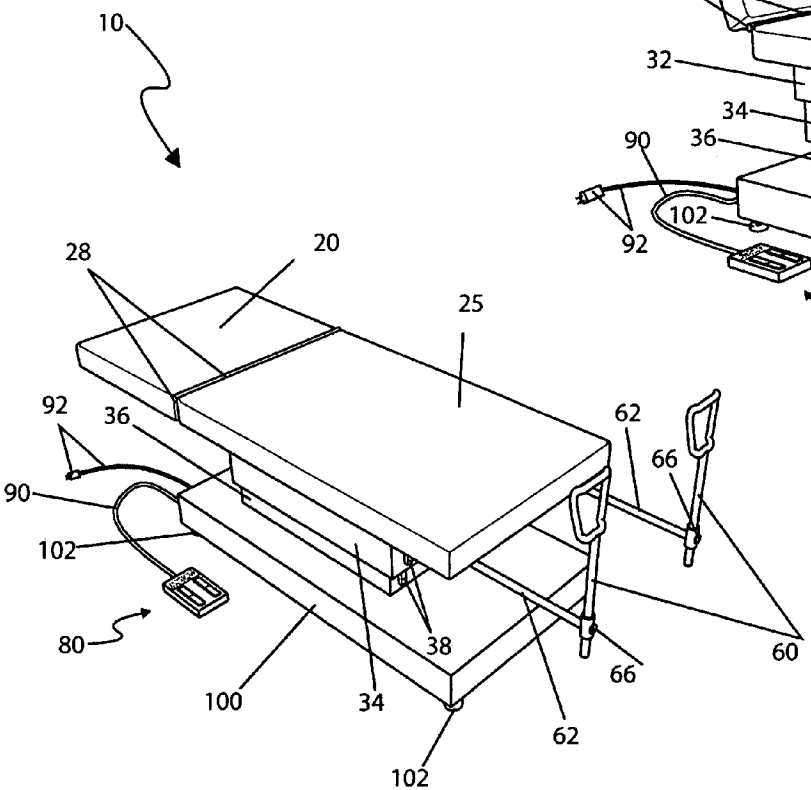
FIG. 2*a* is a perspective view of a height-adjustable examining table 10 depicting a lowered state, according to a preferred embodiment of the present invention.
Figure 2C:
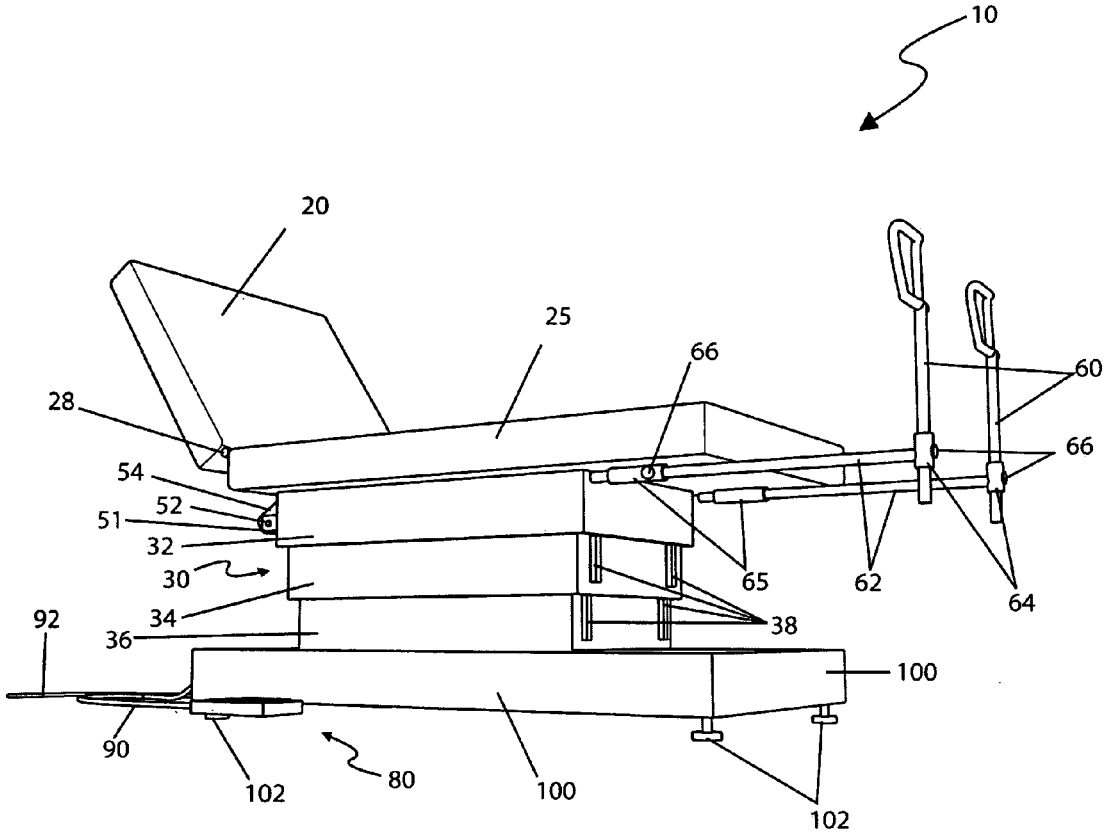
FIG. 2*c* is an upward-looking perspective view of a height-adjustable examining table 10, according to a preferred embodiment of the present invention.

Referring now to FIGS. 2*a*, 2*b*, and 2*c*, perspective views of the apparatus 10 depicting lowered and raised states, and an upward looking view respectively, according to the preferred embodiment of the present invention, are disclosed. The apparatus 10 comprises a lifting frame assembly 30 and a base assembly 100. The lifting frame assembly 30 provides a lifting means to said head 20 and foot 25 cushion sections by elevating said cushion sections 20, 25 from approximately eighteen (18) inches to thirty-six (36) inches above a floor surface allowing a patient to be elevated from an easily accessible sitting height upward to a normal examination height. The lifting frame assembly 30 further comprises a first lifting section 32, a second lifting section 34, and a third lifting section 36. The lifting frame assembly 30 provides said lifting function via an internal hydraulic lifting cylinder 40 (see FIG. 4). The lifting sections 32, 34, 36 provide a vertically telescoping assembly of interlocking and vertically expanding structures designed to laterally stabilize the lifting frame assembly 30 and apparatus 10 during a loaded state (see FIGS. 4 and 5). The lifting frame assembly 30 also provides an attachment means thereto a base assembly 100 along a lower surface. The base 40 comprises a sturdy assembly of rectangular metal plates providing a laterally expanded foundation to the apparatus 10 and extends outwardly therefrom the lifting frame assembly 30 upon a floor surface.

Figure 3:
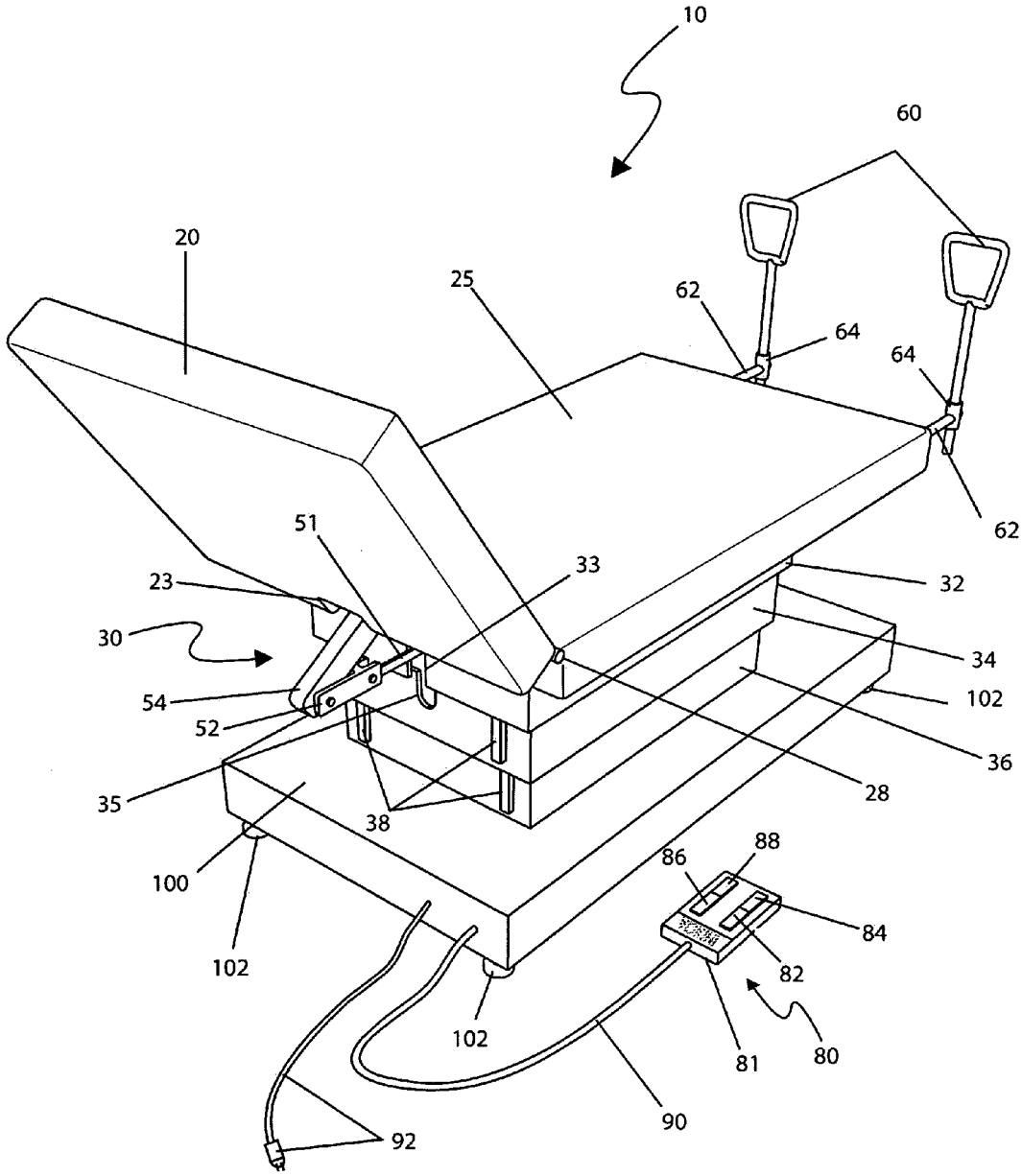
FIG. 3 is a rear perspective view of a height-adjustable examining table 10, according to a preferred embodiment of the present invention.

Referring now to FIG. 3, a rear perspective view of a height-adjustable examining table 10, according to a preferred embodiment of the present invention, is disclosed. The apparatus 10 comprises a tilt cylinder shaft 51, a double clevis link 52, and a torsion arm 54. The torsion arm 54 is permanently affixed thereto and extends rearwardly therefrom the previously described torsion hinge 28 at an intermediate location thereupon. The torsion arm 54 as well as affixed rotating elements of said torsion hinge 28 are rigidly affixed thereto the head cushion section 20 of the apparatus 10, thereby communicating a torque therefrom the torsion arm 54 thereto said head cushion section 20 (see FIG. 4). The torsion arm 54 is capable of applying said torsion force via drive devices including the tilt cylinder 50, a tilt cylinder shaft portion 51, and a rotating double clevis link 52 (see FIG. 4). The head cushion section 20 also comprises a head section slot 23 which provides mechanical clearance thereto the torsion arm 54 during operation, thereby allowing said head cushion section 20 to recline thereto a horizontal position. Additionally, the first 32 and second 34 lifting sections of the lifting frame assembly 30 comprise a first lifting section slot 33 and a second lifting section slot 35, respectively, being immediately subjacent thereto the torsion arm 54 and providing additional clearance for said drive components during operation of the tilting function.

Figure 4:
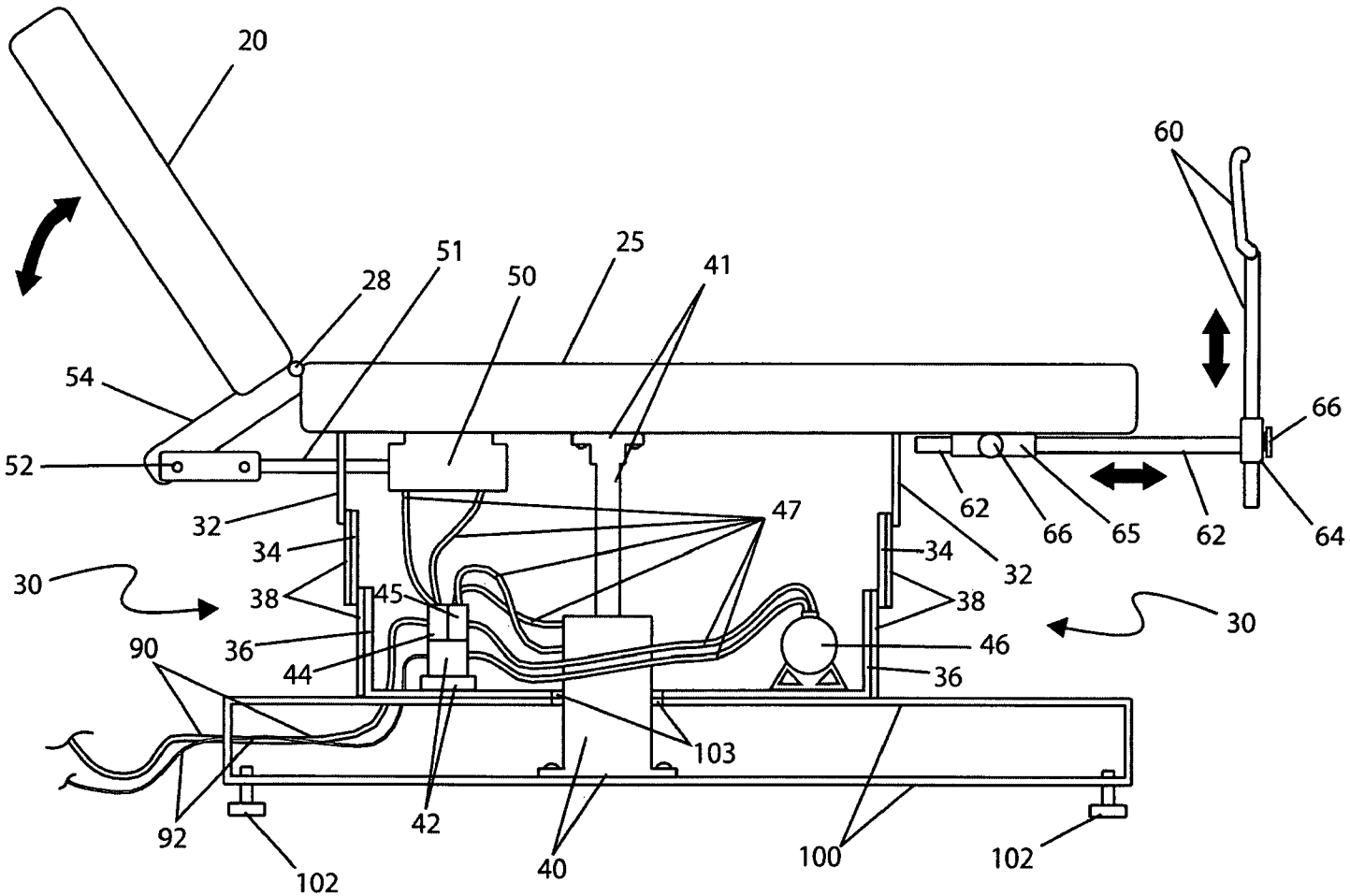
FIG. 4 is a section view taken along section A-A (see FIG. 2*b*) of a height-adjustable examining table 10, according to a preferred embodiment of the present invention.
Figure 5:
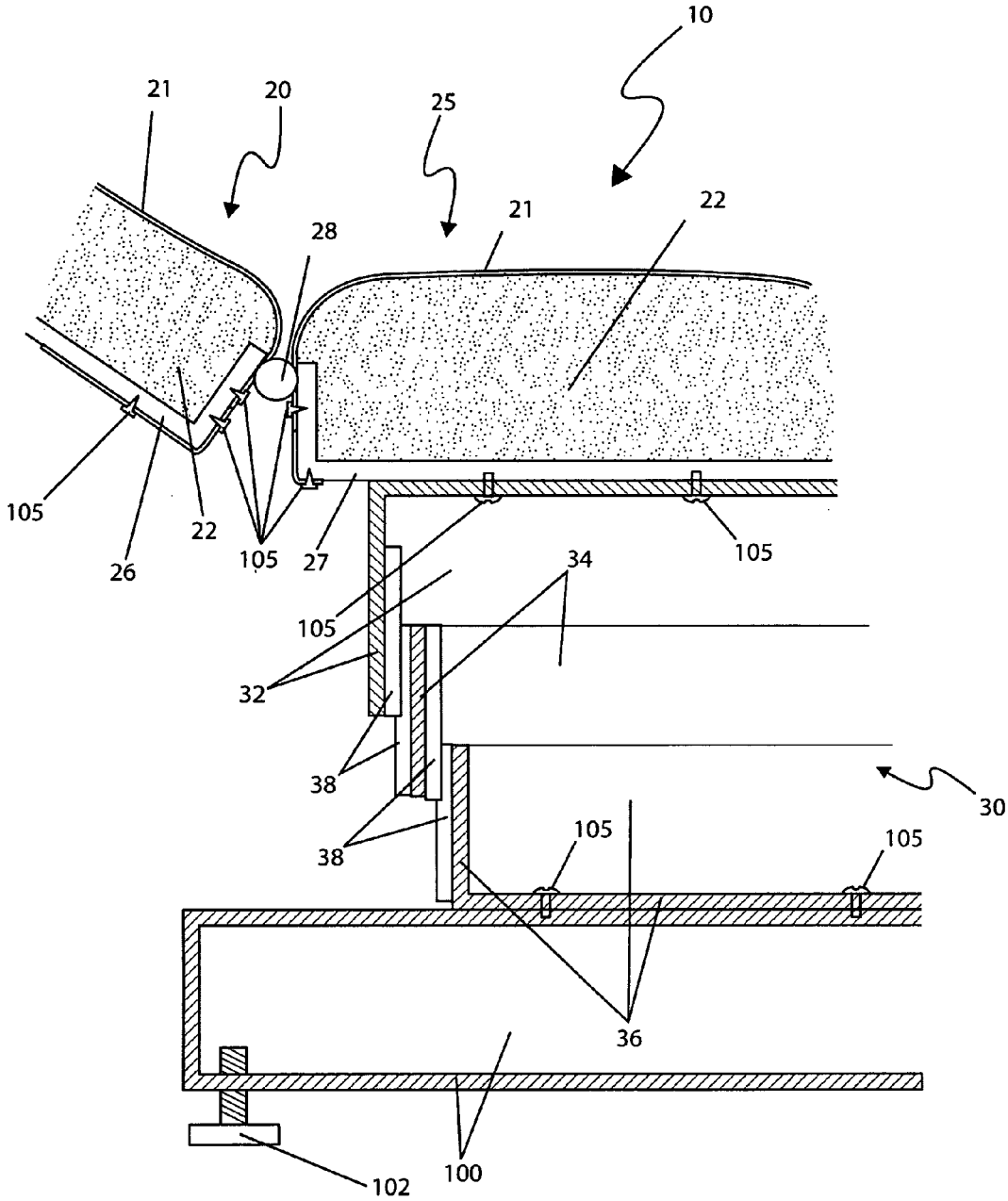
FIG. 5 is a partial section view taken along section B-B (see FIG. 2*b*) of a height-adjustable examining table 10, according to a preferred embodiment of the present invention; and, FIG. 6 is a hydraulic/electrical block diagram of a height-adjustable examining table 10, according to a preferred embodiment of the present invention.

Referring now to FIGS. 4 and 5, section views taken along sections A-A and B-B, respectively, (see FIG. 2*b*) of a height-adjustable examining table 10, according to a preferred embodiment of the present invention, are disclosed. The apparatus 10 comprises head 20 and leg 25 cushion sections further comprising a cushion covering 21, a quantity of internal cushion padding 22, a head cushion frame 26, and a leg cushion frame 27. The cushion padding 22 is envisioned to comprise urethane foam or similar synthetic or natural filling materials, thereby providing a comfortable laying and sitting surface. As illustrated in FIG. 5, said head 20 and leg 25 cushion sections further comprise a cushion covering 21 envisioned to be made of vinyl, cloth, leather, or the like, being easily cleaned. The frame portions 26, 27 comprise rugged metal or wood internal structures along bottom and side surfaces therebeneath said covering 21, thereby providing a rigid foundation thereto said cushion sections 20, 25 as well as providing an attachment means thereto the lifting frame assembly 30 and the torsion hinge 28.

The leg cushion 25 further comprises a pair of conventional stirrups 60. Said stirrups 60 provide typical horizontal and vertical adjustment via a pair of vertical stirrup rod guides 64, a pair of horizontal stirrup rod guides 65. and corresponding threaded rod locking knobs 66. The lifting frame assembly 30 provides a protective enclosure thereto the lifting cylinder 40, and a tilt cylinder 50.

The lifting 40, and tilt 50 cylinders are mounted therewithin an enclosed space formed by the lifting frame assembly 30. The lifting frame assembly 30 comprises three (3) lifting sections 32, 34, 36 providing a vertically telescoping assembly of interlocking panels being inserted thereinto one another via respective incrementally reducing outer dimensions as seen here. The first 32 and third 36 lifting sections are located at top and bottom portions and comprise five-sided metal structures being stationarily affixed thereto the leg cushion frame portion 27 and base assembly 100, respectively, using common fasteners 105 such as rivets, screws, bolts, or the like. The second lifting section 34 is located therebetween the first 32 and third 36 lifting sections and comprises a rectangle-shaped horizontal metal structure having vertical sides. As seen in FIG. 5, adjacent lifting sections 32, 34, 36 are attached thereto one another via a plurality of linear ball-bearing units 38 using common fasteners 105. The bearing units 38 are arranged in pairs and positioned vertically along front and rear surfaces of said lifting sections 32, 34, 36 (see FIGS. 2*b* and 3). The linear bearing units 38 comprise common commercially available sealed ball-bearing assemblies and provide torsional stability thereto the lifting frame assembly 30 and apparatus 10 during a loaded state. Additionally, said bearing units 38 secure the lifting sections 32, 34, 36 in a horizontal attitude while enabling adjacent pairs of lifting sections 32, 34, 36 to move freely therewithin one another vertically during operation of the lift cylinder 40.

The lifting cylinder 40 comprises a lifting cylinder shaft 41 which extends in an upward direction being affixed at a top end portion thereto a top horizontal surface thereof the first cushion frame 26 at an approximate "center-of-load" position using common fasteners 105. The lift cylinder 40 subsequently extends downwardly therethrough a circular-shaped base assembly aperture portion 103 of the base assembly 100 and is anchored along a bottom panel portion of the base assembly 100 also using common fasteners 105. Said arrangement of the lift cylinder 40 is designed to maximize a total vertical displacement of the leg cushion section 25. The lift cylinder 40 comprises a vertical stroke of approximately eighteen (18) inches and a minimum lifting capacity of three-hundred fifty (350) pounds, thereby providing a vertically adjustable and selectable positioning means thereto the head 20 and leg 25 cushion portions of the apparatus 10.

The tilt cylinder 50 provides angular manipulation of the head cushion section 20 by directly applying a torque force thereto the previously described torsion hinge 28 (see FIG. 3). Said tilt cylinder 50 is in mechanical communication therewith said torsion hinge 28 via a tilt cylinder shaft 51, a double clevis link 52, and a torsion arm 54. The tilt cylinder 50 is affixed thereto a horizontal upper surface of the first lifting section 32 in a horizontal orientation. The lifting cylinder 40 and tilt cylinder 50 are attached thereto the apparatus 10 using standard fasteners 105 and hardware such as screws, bolts, or the like in an expected manner. The tilt cylinder shaft portion 51 of the tilt cylinder 50 extends horizontally toward a rear portion of the apparatus 10 protruding therethrough the first lifting section slot portion 33 of said first lifting section 32 and being affixed thereto the torsion arm 54 via a standard double clevis link 52. The double clevis link 52 provides a compliant angular pinned connection therebetween said lift cylinder shaft 51 and the torsion arm 54 during operation of the tilt cylinder 50.

Figure 6:
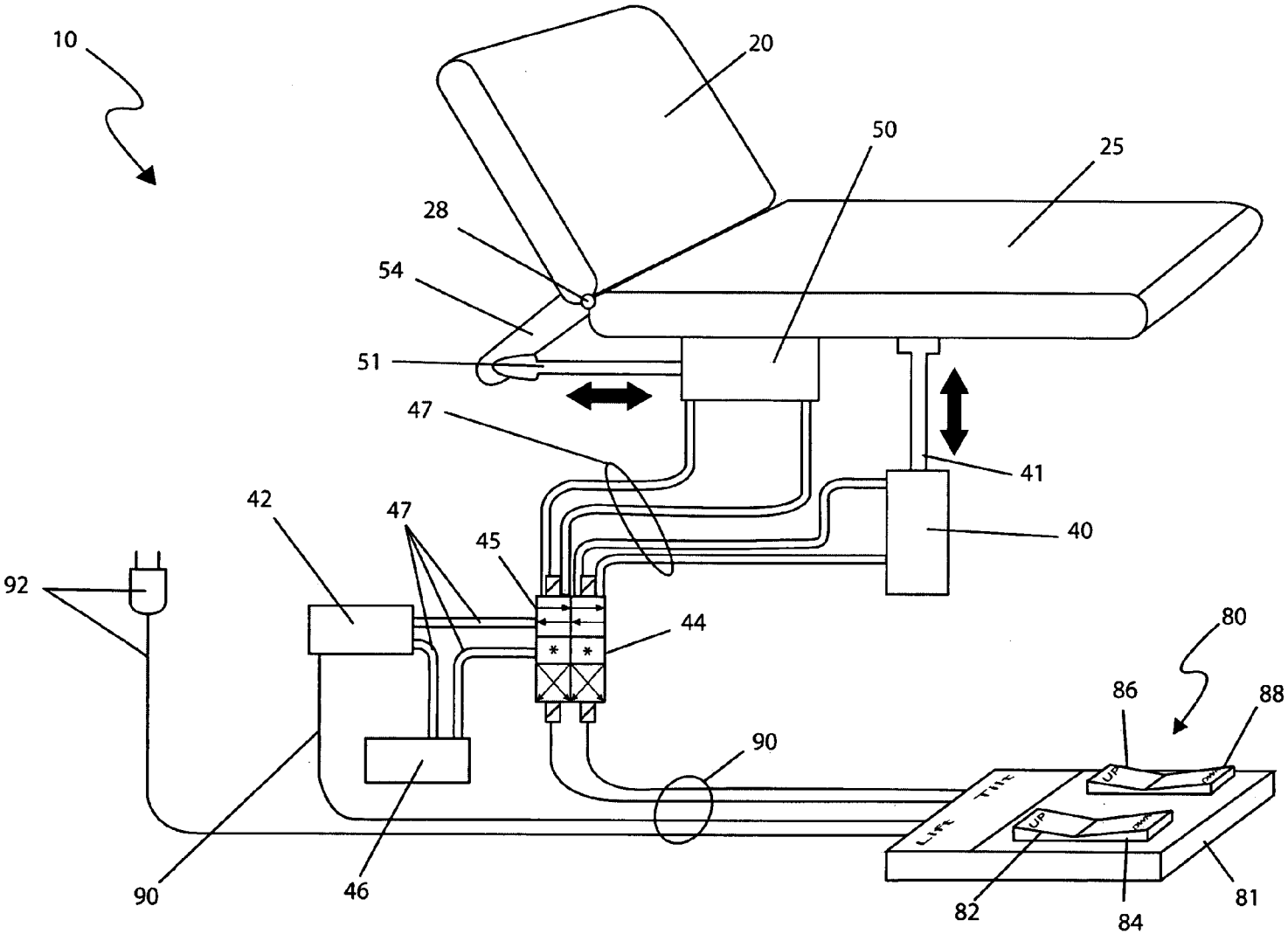

The lift cylinder 40 and tilt cylinder 50 are hydraulically powered via a common open-loop hydraulic circuit comprising an electric hydraulic motor/pump 42, a lifting cylinder valve 44, a tilt cylinder valve 45, a reservoir 46, a plurality of hydraulic hoses 47, and a foot-controlled pedal switch assembly 80 (see FIG. 6). The hydraulic motor/pump 42 is envisioned to be a common positive-displacement gear pump unit providing standard features such as an integral motor, check and relief valves, fluid pumping components, and the like. The lifting 44 and tilt 45 cylinder valves comprise standard double-solenoid three-position hydraulic valves providing direction of pressurized hydraulic fluid thereto said cylinders 40, 50 as well as providing spring-return center positions to securely maintain a stationary position of the head 20 and leg 25 cushion sections once a desired position is selected. The reservoir 46 provides a volume of hydraulic fluid thereto the hydraulic motor/pump 42 in an expected manner via a hydraulic hose 47. Furthermore, transportation of said hydraulic fluid is conveyed thereto said valves 44, 45 and cylinders 40, 50 via a plurality of common high-pressure hydraulic hoses 47. It is understood that various arrangements of said hydraulic system components 42, 44, 45, 46, 47 may be utilized based upon space and design constraints and as such should not be interpreted as a limiting factor of the apparatus 10. Operation and control of said hydraulic system is accomplished via a pedal switch assembly 80 (see FIGS. 3 and 6).

The base assembly 100 comprises four (4) foot pads 102 located along a bottom surface of said base assembly 100 adjacent thereto each corner position. Said foot pads 102 comprise common hardware fixtures having expected features such as a threaded adjustable bolt-like attachment means, a rubberized floor contact surface, and the like.

Referring now to FIG. 6, a hydraulic/electrical block diagram of the apparatus 10, according to the preferred embodiment of the present invention, is disclosed. The apparatus 10 comprises a plurality of hydraulic hoses 47, a plurality of control wires 90, a power cord 92, and a pedal switch assembly 80. Electrical power is provided to the pedal switch assembly portion 80 of the apparatus 10 using a common 110-volt power cord 92 utilizing a normal 110-volt duplex outlet. The pedal switch assembly 80 provides electrical switching functions via a plurality of integral contact closure devices, thereby directing an electrical current thereto various components of the apparatus 10; however, it is understood that additional electrical and electronic technologies such as, but not limited to: microprocessor-type logic-based circuits and the like, being incorporated therein and as such should not be interpreted as a limiting factor of the apparatus 10. Electrical power is selectively directed thereto the hydraulic motor/pump unit 42 and cylinder valves 44, 45 via manual actuation of the pedal switch assembly 80.

The pedal switch assembly 80 further comprises a rugged and protective plastic or metal pedal switch housing 81, a tilt up pedal switch 82, a tilt down pedal switch 84, a lift up pedal switch 86, and a lift down pedal switch 88. Said tilt pedal switches 82, 84 and lift pedal switches 86, 88 comprise respective center-return rocker-type foot-operated switches; however it is understood that various styles of switches, additional switches, and/or additional lifting/tilting functions may be provided as desired and as such should not be interpreted as a limiting factor of the apparatus 10. The pedal switches 82, 84, 86, 88 provide expected functions including "TILT UP", "TILT DOWN", "LIFT UP", and "LIFT DOWN" as provided by the pedal switch assembly 80. Electrical power is conducted therefrom the pedal switch assembly 80 thereto the valves 44, 45 and hydraulic motor/pump unit 42 via interconnecting control wiring 90, thereby directing hydraulic pressure thereto the lifting 40 and tilting 50 cylinders as required via hydraulic hoses 47. The valves 44, 45 and the hydraulic motor/pump 42 comprise a simple open-loop hydraulic circuit to direct hydraulic pressure to the lifting cylinder 40 or the tilt cylinder 50 accordingly, when specific pedal switches 82, 84, 86, 88 are depressed by an operator. Actuation of any particular pedal switch 82, 84, 86, 88 will provide an electrical signal thereto the hydraulic motor/pump 42 and appropriate valve 44, 45, thereby providing subsequent hydraulic pressure thereto the lift 40 and tilt 50 cylinders until said cylinders 40, 50 extend or retract thereto a mechanical limit of motion, or until the corresponding pedal switch 82, 84, 86, 88 is released.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 2*a*, 2*b*, and 2*c*.

The method of installing and utilizing the apparatus 10 may be achieved by performing the following steps: placing or securing the apparatus 10 upon a floor surface therewithin a doctor's office, a hospital, or similar medical establishment; providing electrical power to the apparatus 10 by plugging the power cord 92 into an available 110-volt duplex outlet; lowering a leg cushion section 25 of the apparatus 10 by pressing and holding the lift down pedal switch 88, thereby actuating the lifting cylinder 40 therein a downward direction; releasing the lift down pedal switch 88 when the apparatus 10 is at a desired loading height; loading a patient onto the apparatus 10; raising the apparatus 10 by pressing and holding the lift up pedal switch 86 on the pedal switch assembly 80; releasing the lift up pedal switch 86 when the leg cushion section portion 25 of the apparatus 10 is at a desired examining height; tilting the head cushion section 20 up or down by pressing and holding the corresponding tilt up pedal switch portion 82 or tilt down pedal switch portion 84 until obtaining a desired reclining angle of the head cushion section 20; manually adjusting the foot stirrups 60 using the stirrup adjustment rods 62 and the stirrup rod locking knobs 66 as required to prepare the apparatus 10 for a doctor or other medical personnel to perform needed medical procedures; adjusting the position of the head cushion section 20 when finished performing said medical procedures, to facilitate a sitting position by actuating the tilt cylinder 50 using the tilt up pedal switch 82; lowering the apparatus 10 by actuating the lifting cylinder 40 using the lift down pedal switch 88; releasing said lifting pedal switch 88 when the apparatus 10 is at a desired unloading height; unloading a patient therefrom the apparatus 10; and, benefiting from increased safety and reduced effort of persons undergoing medical examinations using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A height-adjustable examining table having a head cushion section hingedly connected with a torsion hinge to a leg cushion section, comprising:

a lifting mechanism mechanically connected therewith said table; and, a hydraulically-powered tilting mechanism mechanically connected therewith said head cushion section, further comprising:

a torsion arm mechanically connected with said torsion hinge;

a tilt cylinder;

a tilt cylinder shaft mechanically connected therewith said tilt cylinder; and, a double clevis link mechanically connected therewith said tilt cylinder and mechanically connected therewith said torsion arm;

wherein said tilt cylinder drives said tilt cylinder shaft; and, wherein said head cushion section comprises a head section slot to permit clearance of said torsion arm during said pivoting means, thereby allowing said head cushion section to recline thereto a horizontal position; and, a foot pedal switch device selectably positioned adjacent to said table, comprising a resilient unitary housing providing an operational means for said lifting mechanism and said tilting mechanism;

wherein said torsion arm provides said pivoting means for said head cushion section;

wherein said lifting mechanism provides a means to raise and lower said table to a desired height position; and, wherein said tilting mechanism provides a pivoting means therefor said head cushion section to a desired position.

2. The table of claim 1, wherein said head cushion section can be pivoted forward and backward ninety degrees (90°).

3. The table of claim 1, wherein said table can be raised from approximately eighteen (18) inches to thirty-six (36) inches above a ground surface.

4. The table of claim 1, wherein said lifting mechanism comprises:

a lifting cylinder; and, a lifting cylinder shaft mechanically connected therewith said lifting cylinder and said table;

wherein said lifting cylinder drives said lifting cylinder shaft.

5. The table of claim 4, wherein said lifting mechanism is hydraulically powered.

6. The table of claim 4, wherein said lifting mechanism is operated using a foot pedal switch device.

7. The table of claim 6, wherein said foot pedal switch device comprises a lift up button and a lift down button, thereby allowing a user to control said means to raise and lower said table.

8. The table of claim 4, wherein said lifting cylinder comprises a vertical stroke of approximately eighteen (18) inches.

9. The table of claim 4, wherein said lifting cylinder comprises a minimum lifting capacity of approximately three-hundred fifty (350) pounds.

10. The table of claim 4, wherein said lifting mechanism and said tilting mechanism each are housed substantially inside a lifting frame assembly.

11. The table of claim 10, wherein an upper portion of said lifting frame assembly is connected thereto a lower surface of said table and a lower portion of said lifting frame assembly is connected thereto an upper surface of a base assembly, wherein said base assembly provides a plurality of foot pads, thereby providing a stable base thereto said table.

12. The table of claim 10, wherein said lifting frame assembly further comprises:

a first lifting section connected thereto a bottom surface of said leg cushion section;

a second lifting section mechanically connected therewith said first lifting section; and, a third lifting section mechanically connected therewith said second lifting section;

wherein said first lifting section, said second lifting section, and said third lifting section are raised and lowered by said lifting cylinder; and, wherein said first lifting section, said second lifting section, and said third lifting section form a vertically telescoping and interlocking structure.

13. The table of claim 1, wherein said foot pedal switch device comprises a tilt up button and a tilt down button, thereby allowing a user to control said pivoting means therefor said head cushion section.

14. The table of claim 1, wherein said table further comprises a pair of stirrups each connected thereto a said leg cushion section by a stirrup adjustment rod.

15. A method for using a height-adjustable examining table having a head cushion section hingedly connected with a torsion hinge to a leg cushion section, said method comprising the steps of:

providing said table, comprising:

a lifting mechanism mechanically connected therewith said table; and, a hydraulically-powered tilting mechanism mechanically connected therewith said head cushion section, further comprising a torsion arm mechanically connected with said torsion hinge; and, a foot pedal switch device selectably positioned adjacent to said table, comprising a resilient unitary housing providing an operational means for said lifting mechanism and said tilting mechanism;

wherein said torsion arm provides said pivoting means for said head cushion section;

wherein said lifting mechanism provides a means to raise and lower said table to a desired height position; and, wherein said tilting mechanism provides a pivoting means therefor said head cushion section to a desired position;

placing or securing said table upon a ground surface therewithin a doctor's office, a hospital, or similar medical establishment;

providing electrical power to said table by plugging a power cord into an available 110-volt duplex outlet;

lowering said leg cushion section of said table by pressing and holding a lift down button of a foot pedal switch device, thereby actuating a lifting cylinder therein a downward direction;

releasing said lift down button when said table is at a desired loading height;

loading a patient onto said table;

raising said table by pressing and holding a lift up button of said foot pedal switch device;

releasing said lift up button when said leg cushion section of said table is at a desired examining height;

tilting said head cushion section up or down by pressing and holding a tilt up button of said foot pedal switch device or a tilt down button of said foot pedal switch device until obtaining a desired reclining angle of said head cushion section;

manually adjusting a foot stirrup portion using a stirrup adjustment rod and a stirrup rod locking knob as required to prepare said table for a doctor or other medical personnel to perform needed medical procedures;

adjusting a position of said head cushion section when finished performing said medical procedures, to facilitate a sitting position by actuating a tilt cylinder using said tilt up button;

lowering said table by actuating a lifting cylinder using said lift down button;

releasing said lift down button when said table is at a desired unloading height;

unloading said patient therefrom said table; and, benefiting from increased safety and reduced effort of persons undergoing medical examinations using said table.

* * * * *